US006390651B2

(12) United States Patent
Bertrand

(10) Patent No.: US 6,390,651 B2
(45) Date of Patent: May 21, 2002

(54) TOY WITH BALLOON AND LIGHTING APPARATUS

(76) Inventor: Timothy R. Bertrand, 49 Massachusetts Ave., Somerset, MA (US) 02726

( * ) Notice: Subject to any disclaimer, the term of this patent is extended or adjusted under 35 U.S.C. 154(b) by 0 days.

(21) Appl. No.: 09/725,702

(22) Filed: Nov. 29, 2000

Related U.S. Application Data

(63) Continuation-in-part of application No. 09/457,924, filed on Dec. 9, 1999.

(60) Provisional application No. 60/206,894, filed on May 25, 2000.

(51) Int. Cl.[7] ..... F21V 1/06

(52) U.S. Cl. ..... 362/352; 362/101; 362/154; 440/220

(58) Field of Search ..... 362/806, 253, 362/800, 154, 101, 96; 446/220, 225, 485; D21/440, 445; D11/163; 40/212, 214

(56) References Cited

U.S. PATENT DOCUMENTS

| | | | | |
|---|---|---|---|---|
| 4,884,987 | A | 12/1989 | Mason | |
| 4,997,403 | A | 3/1991 | Akman | |
| 5,075,830 | A | 12/1991 | Perez | |
| 5,117,344 | A | 5/1992 | Perez | |
| 5,119,281 | A | 6/1992 | Akman | |
| 5,215,492 | A | 6/1993 | Kubistowicz | |
| 5,444,607 | A | 8/1995 | Dreyfuss | |
| 5,947,581 | A | 9/1999 | Schrimmer | |
| 6,238,067 | B1 * | 5/2001 | Hirsch | 362/352 |

FOREIGN PATENT DOCUMENTS

| | | |
|---|---|---|
| DE | 89 05 690 | 7/1989 |

* cited by examiner

*Primary Examiner*—Sandra O'Shea
*Assistant Examiner*—Hargobind S. Sawhney
(74) *Attorney, Agent, or Firm*—John L. Lee

(57) ABSTRACT

A toy simulates an illuminated overhead moon with a long-legged spacecraft under it. The toy includes a lighting apparatus secured to a balloon by string under tension. The lighting apparatus, located wholly outside the balloon, illuminates the inside of the balloon so the balloon appears to glow. The lighting apparatus has at least three arms extending from a body having a locking fastener. The locking fastener is attached by string under tension to the neck of the balloon. Each arm terminates in a window for contacting the skin of the balloon and for transmitting light through the skin to the interior of the balloon. In a preferred embodiment, the lighting apparatus is of sufficiently low weight that the toy floats in air.

16 Claims, 9 Drawing Sheets

TOY WITH BALLOON AND LIGHTING APPARATUS

This application is a continuation-in-part of co-pending U.S. application Ser. No. 09/457,924, filed Dec. 9, 1999, and co-pending U.S. Provisional Application Ser. No. 60/206,894, filed May 25, 2000.

TECHNICAL FIELD

The invention relates generally to illuminated toy balloons.

SUMMARY OF THE INVENTION

The present invention provides a toy having an illuminated balloon, the balloon having a skin and a neck. The toy includes a lighting apparatus secured to the balloon by a first portion of a length of string under tension. The first portion of the length of string is attached under tension between the lighting apparatus and the neck of the balloon. The lighting apparatus, located wholly outside the balloon, illuminates the inside of the balloon so the balloon appears to glow.

In a first preferred embodiment, the lighting apparatus has a body with at least three arms extending therefrom. The body defines a locking fastener having two hooks. The locking fastener is attached by string under tension to the neck of the balloon. The locking fastener prevents the string from slipping over the body. Each arm terminates in a pad having a window for contacting the skin of the balloon and for transmitting light through the skin to the interior of the balloon. The lighting apparatus contains at least one lamp positioned such that light from a lamp shines through each window. The lighting apparatus is of sufficiently low weight that with the balloon filled with helium, the toy floats in air. Also, the balloon simulates an illuminated overhead moon, and the lighting apparatus simulates a long-legged spacecraft.

The body includes a hinged shell with slots. The slots define the two hooks.

The locking fastener includes a first string fastener and a second string fastener.

The body includes a hinged shell wired to accept a battery.

Each arm is flexible, and each pad is adapted for rotary movement about the end of its arm.

In the first preferred embodiment, a portion of the string is threaded through the lighting apparatus to hold the pads of the lighting apparatus firmly in contact with the surface of the balloon by tension in a proximal portion of the string. The proximal portion of the string is attached at its other end to the neck of the balloon. The pads collectively press against the balloon with a force equal to the tension in the length of the string. A distal portion of the string is used to tether the toy.

Another embodiment provides a toy simulating an illuminated overhead moon. This embodiment includes an air-filled inflated balloon illuminated by a lighting apparatus mounted on an elongated handle.

The invention also provides a method for attaching the lighting apparatus to an inflated balloon. The method includes tying one end of a length of the string to the neck, and tying the other end under tension to the body. The pads are held firmly in contact with the outer surface of the balloon by the tension in the string while a light source in each pad illuminates the interior of the balloon.

DETAILED DESCRIPTION

General

Figure 1:
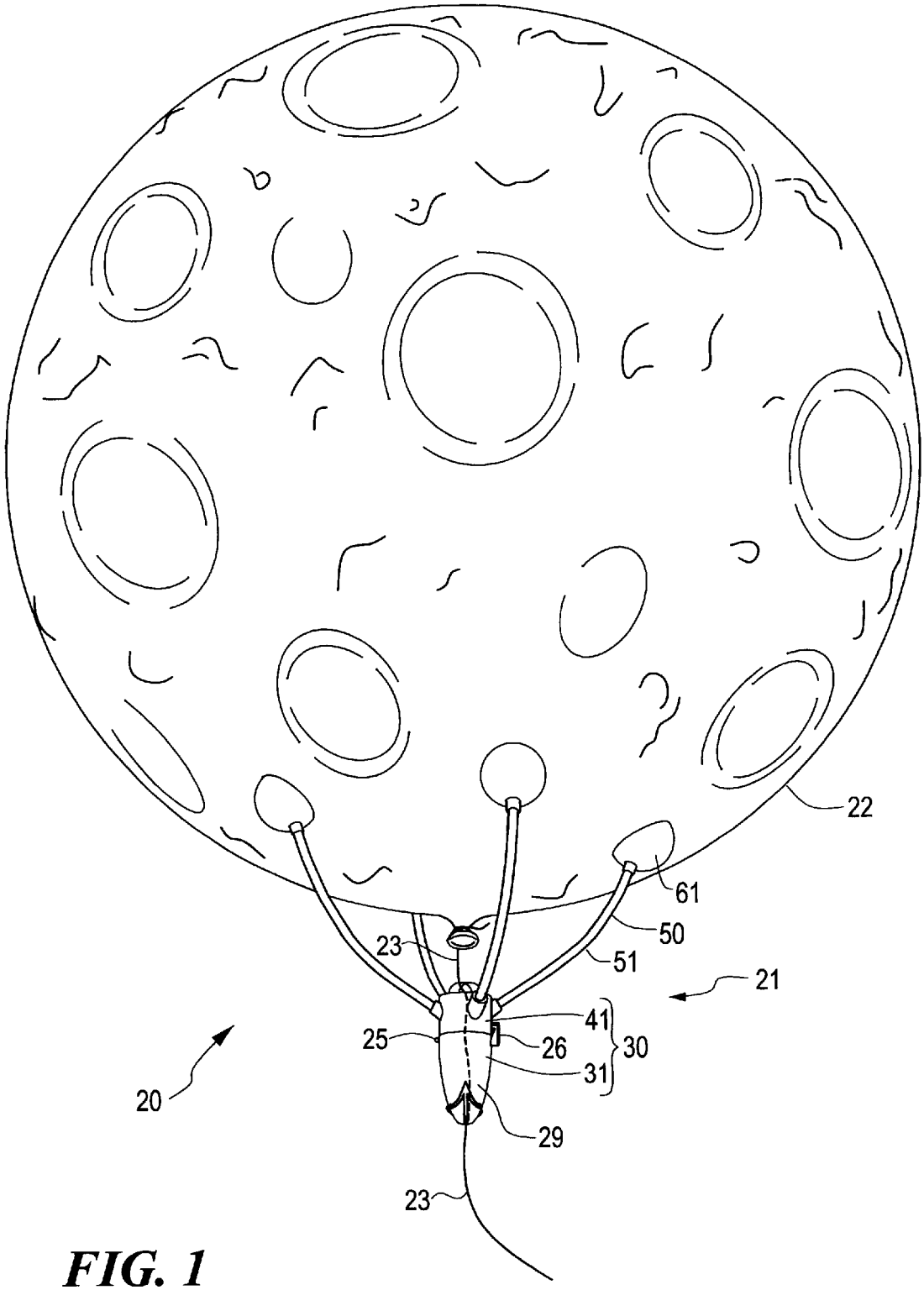
FIG. 1 is a perspective view of a first embodiment of the assembled toy of the invention, showing the balloon, the string and the lighting apparatus.

The assembled toy, according to a first embodiment, is shown in FIG. 1. Toy 20 includes lighting apparatus 21, balloon 22, and string 23. The toy also includes a battery (not shown).

Balloon 22 when inflated is substantially spherical and 18–24 inches in diameter. The balloon is made of a latex rubber compound preferably including phosphorescent materials. The balloon has raised areas and texture so that when inflated it resembles the Earth's moon with craters, bumps and texture. The phosphorescent materials cause the balloon to glow when illuminated by the lighting apparatus. The balloon is secured using approximately 4–8 feet of a kite-type string, one end of the string tied to the knotted neck of the balloon.

Figure 2:
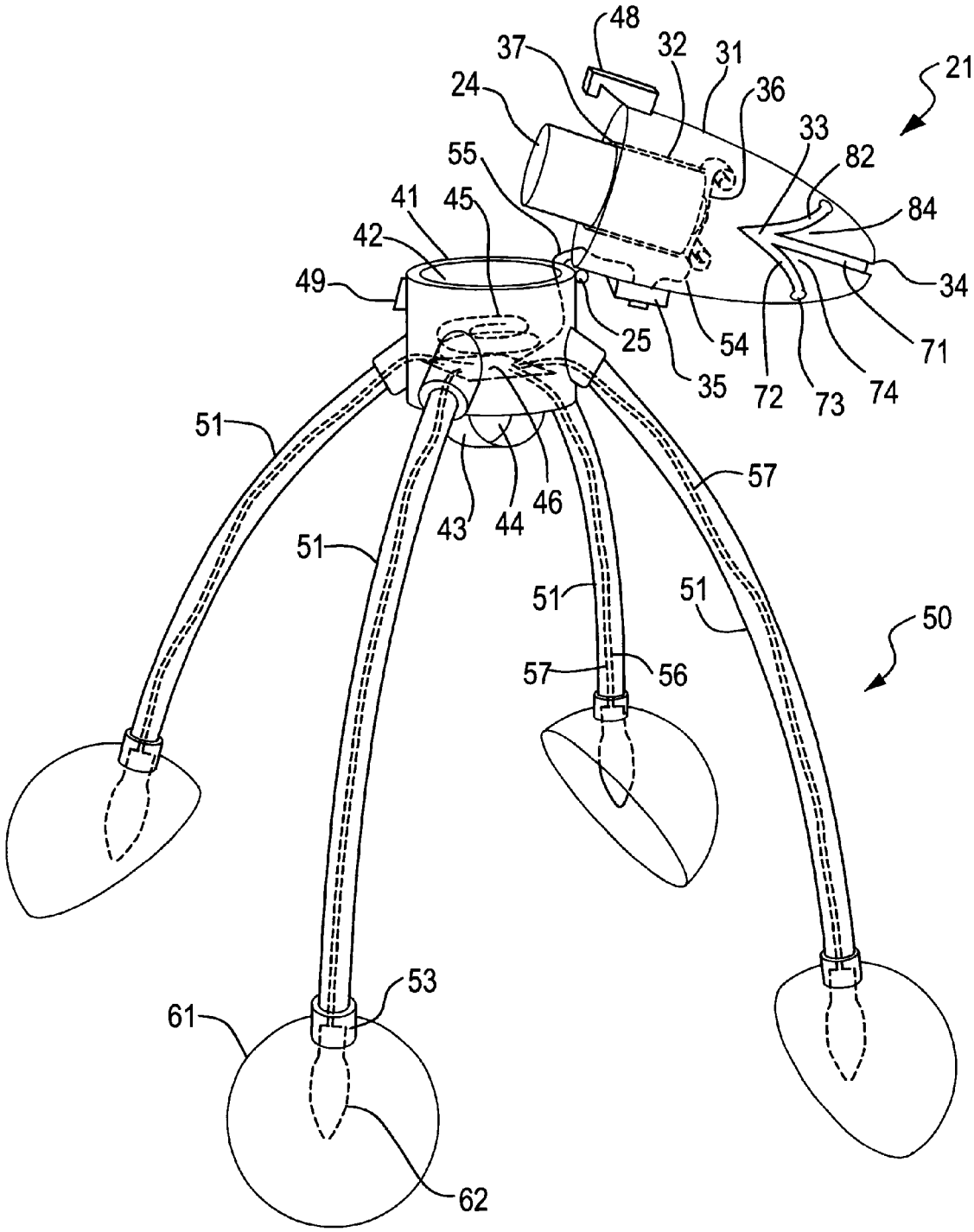
FIG. 2 is a partial cut-away perspective view of the lighting apparatus of FIG. 1.

The lighting apparatus is the light source that illuminates the balloon. Lighting apparatus 21 is approximately 5 inches tall, fully assembled. It resembles a rocket with four extended landing legs. The weight of the lighting apparatus is small enough that the balloon is able to float freely with the lighting apparatus attached to it. Details of the lighting apparatus are shown in FIG. 2. Lighting apparatus 21 includes head 31, base 41, and four arms 50, each arm terminating in a pad 61. The body 30 of lighting apparatus 21 includes head 31 and base 41. Head 31 is cone-shaped and is approximately one inch high. At its narrow end it is approximately ⅛ of an inch in diameter. At its broad end it is approximately ¾ of an inch in diameter. Replaceable battery 24, in the preferred embodiment a cylindrical MN21 12 volt alkaline battery, is shown inside the lighting apparatus. The battery is approximately 1 and ⅛ inches long, and ⅜ of an inch in diameter.

As shown in FIG. 1, head 31 is attached to base 41 by hinge 25 and latch 26 to form body 30. Hinge 25 is preferably an integral plastic hinge of the polypropylene hinge type. Four arms 50 extend from the body, each arm including an elongated conduit 51 and a pad 61.

Latch 26, see FIG. 1, includes catch 48 and detent 49, see FIG. 2. Latch 26 prevents the shell from opening accidentally when the toy is in use. Other forms of latch may be used. On one side of the broad end of head 31 is catch 48. Catch 48 extends beyond head 31 approximately ⅛ of an inch.

Referring again to FIG. 1, in the preferred embodiment, a single plastic shell 29, forms the enclosure of body 30. That is, it forms the enclosure of the head, the base and the hinge. Shell 29 functions as both a battery housing and as a frame for attachment of the arms. The shell is made of a lightweight material, preferably polypropylene to provide an economical hinge.

Head 31 includes a first aperture 32 for admitting a first end of the battery. Shell 29, whose walls form first aperture 32 of the head, is hollow. First aperture 32 (see FIG. 3) is approximately ⅜ of an inch in diameter, sized to contain the battery such as to prevent the battery from moving about. Head 31 includes a first battery contact 36. First battery contact 36 is made of an electrically conductive material such as copper. It is preferably a disk shaped to fit tightly into the head. It is connected via wire 54 to switch 35.

FIG. 2 shows ON/OFF switch 35 for the lighting apparatus, which is preferably a micro slide switch. Alternatively, an ON/OFF micro button (toggle) switch may be used. The wire is extremely small gauge insulated copper, similar to that of wrapping wire for electronics. Both the micro slide switch and the wire are available from Radio Shack. Switch 35 may use a body that is integral with the shell. Switch 35 is attached to the same side of the head as the hinge to avoid stretching wire 55 when the shell is opened to replace a battery. First aperture 32, approximately ⅜ of an inch in diameter, keeps the battery aligned with the first battery contact. When switch 35 is "ON", current from the battery flows via wires 54, 55, and 56 to power a lamp 62, preferably an LED, in each pad and returns to the battery via wires 57, plate 46 and spring 45, which serves as a second battery contact.

Figure 6:
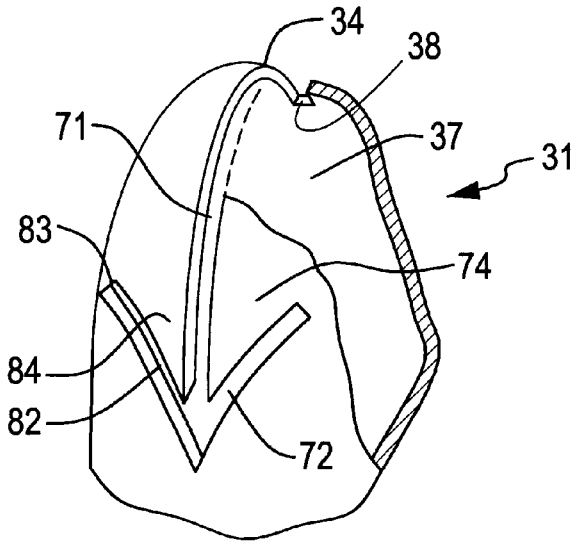
FIG. 6 is a cut-away view of the shell showing the cuts in the head of the preferred embodiment.

First string fastener 33, as shown in FIG. 2, includes an arrow shaped groove defined by axial cut 71, first transverse cut 72, and second transverse cut 82. These three cuts cut through to the hollow interior 37 of head 31. FIG. 6 is a cut-away view of head 31 giving detail of axial cut 71, first transverse cut 72, and second transverse cut 82. Axial cut 71 and first transverse cut 72 define first hook 74. Axial cut 71 and second transverse cut 82 define second hook 84.

Figure 3:
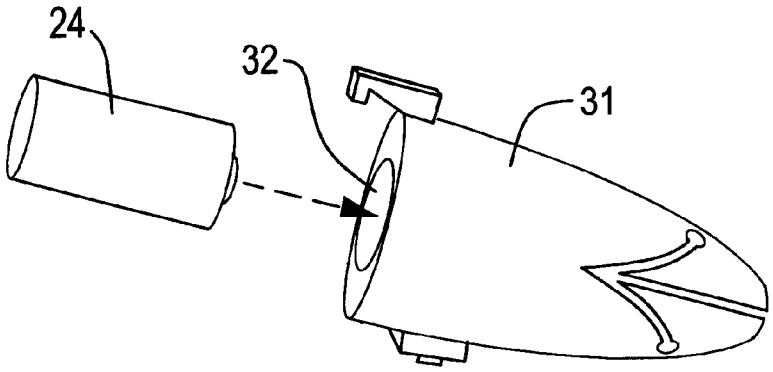
FIG. 3 is a partial cut-away perspective view of the head of the lighting apparatus of FIG. 1, showing a battery aperture and the arrow groove of a first string fastener.

In the preferred embodiment, the groove of axial cut 71 is 1/16 of an inch wide and extends from tip 34 of head 31 3/16 of an inch on the side shown in front view in FIGS. 1 and 3. The other side of the groove of axial cut 71 is shown in FIG. 6 as a ¼ of an inch straight cut from tip 34 to ridge 38. It can be seen from FIG. 6 that most of the grooves of the first string fastener on one side of the head. First transverse cut 72 and second transverse cut 82 extend approximately ⅛ inch to first end 73 and second end 83, respectively.

The first string fastener is designed to lock the string to the head to hold the lighting apparatus firmly against the balloon, and to prevent the toy from sliding down the string away from the balloon. It is also designed so that the string exits at tip 34 of the head, so as to keep the string, the toy, and the balloon aligned with one another.

Base 41 is molded from the same plastic as the head and hinge 25. Base 41 defines a second aperture 42 for containing a second end of the battery, and a second string fastener 43 in the form of an arch member defining hole 44. Mounted within base 41 is spring 45 which serves as a second battery contact. Thus, electrical coupling is provided, via spring 45, plate 46, and wires 57, between the second end of the battery and the four illuminating pads 61.

The locking fastener includes first string fastener 33 having two hooks, the hooks defined by slots in the shell and second string fastener 43.

Spring 45 is made of electricity conductive spring metal. Its broad end is ¼ of an inch in diameter and spiral tapers to 1/16 of an inch. Its height is approximately 3/16 of an inch. The broad end of spring 45 is attached to plate 46. Plate 46 is a conductive metal disk having a diameter of approximately 5/16 of an inch. The bottom of the plate is fastened by epoxy to the inside bottom of the base. The plate is less than 1/16 of an inch thick. When the head and base of the toy are latched together, the battery's negative contact makes contact with the spring. The spring provides constant pressure at the first contact in the head of the toy, and at the second contact in the base of the toy.

Base 41 is approximately half an inch high and substantially cylindrical in shape, having a diameter of approximately ¾ of an inch. The base is made of the same lightweight plastic material as the head. The base is hollow, open at the top and closed at the bottom.

Second string fastener 43 is a small lug with a small hole 44 passing through it. The hole is approximately ⅛ of an inch in diameter. The lug is centrally located outside the base, under the bottom of the base, as illustrated in FIG. 2. It is approximately ¼ of an inch high, ¼ of an inch wide, and ⅛ of an inch thick. The lug is preferably formed integral with the shell. The function of the second string fastener is to keep the lighting apparatus aligned with the balloon and to maintain tension in the string between the lighting apparatus and the balloon so as to hold the pads firmly on the balloon.

Four cylindrical first sleeves 52, angled downward approximately 15 degrees, are equally spaced around the base. These first sleeves join the base to the conduits. Plate 46 is fixedly mounted inside the closed end of the base and spring 45 is attached to the plate. From the plate wires 57 run through the first sleeves and into the conduits.

Four hollow conduits 51 are attached at one end to base 41 by first sleeves 52, and are attached at the other end to pads 61 by second sleeves 53.

Each conduit 51 is made from thin, flexible plastic. Each conduit is approximately 3½ inches long and has an arc of approximately thirty degrees. Each conduit is cylindrical and hollow—like a straw. The arc and flexibility of each conduit allows the lighting apparatus to automatically conform to any balloon with a diameter in the range 18–24 inches. The flexibility also helps to maintain the tension needed to hold the pads firmly on balloon's skin.

Each first sleeve 52 is cylindrical in shape, and is preferably molded with the base as one piece. Each first sleeve is angled downward from the base at approximately 15 degrees. The first sleeves are evenly spaced around the base of the lighting apparatus.

Each second sleeve 53 is an extension of the pad and is preferably molded with the pad as one piece. A conduit 51 fits into an aperture of the second sleeve and is secured therein by an adhesive such as epoxy to join the conduit and pad.

Figure 4:
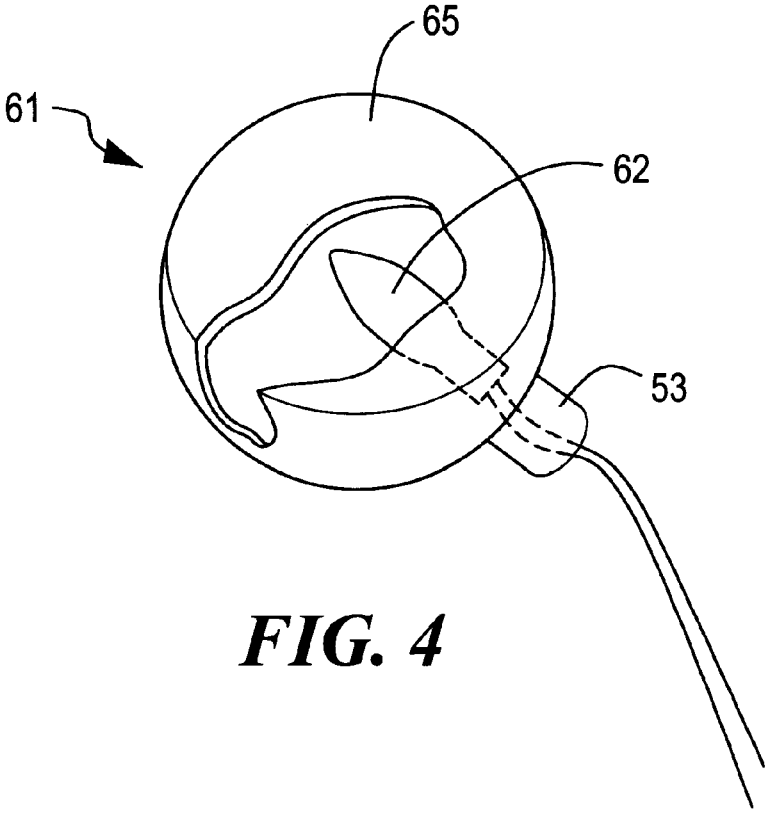
FIG. 4 is a partially cut-away perspective view of a pad of the embodiment of FIG. 1 showing the window.

Pad 61 is shown in detail in FIG. 4. FIG. 4 is a partially cut-away perspective view showing light emitting diode (LED) 62 and window 65. Window 65 also serves as a lens. In use, the outer surface of the window is in contact with the balloon.

Pad 61 includes a hemispherical hollow shell. In the preferred embodiment, there are four pads. Each pad is 1 inch in diameter at its opening and ½ an inch deep. The pads are made of a rigid, lightweight, plastic composite. Fixedly mounted to the outside of each pad is a second sleeve 53 for joining the conduit to the pad. The second sleeve is placed off center by approximately 15 degrees, and angled approximately 15 degrees. The angles allow the pads to conform to the diameter of the balloon. Wires placed through the conduits enter each pad through the second sleeves and are attached to the leads of each light bulb or diode contained in the pad. The inside of each pad is painted chrome or other reflective paint to reflect light generated by the light bulb or diode. The open side of the pad is protected by a thin plastic window (or lens). The window allows the light to pass into the balloon. The window also protects the light bulb or diode, and the skin of the balloon.

Each of the four pads contain a lamp, preferably an LED 62. The preferred embodiment uses a set of 5 mm, 1.7–2.1 volt, 30 mA light emitting diodes (LED's), having a luminous intensity of 1,300 mcd–3,000 mcd. The direct viewing angle on either side is approximately 12–15 degrees. It is recommended that each pad contains a diode of the same color. LED's are available from Radio Shack. The distal face of each pad is covered by a thin clear plastic window, which allows the light through, yet protects the bulb and balloon when the pads are in contact with the balloon. The window is made from a thin, clear, plastic composite. It is a disk having a diameter of approximately ⅞ of an inch, and a thickness of approximately 1/16 of an inch. The window fits closely inside the edge of each pad so that it is flush with the edge of the pad, so as not to emit light around the edges of the pad. The inside cavity of each pad, facing the window, is painted with a light reflective material so as to focus reflected light out through the window. The window may be shaped as a lens to further ensure an optimum distribution of light in the interior of the balloon.

Figure 7:
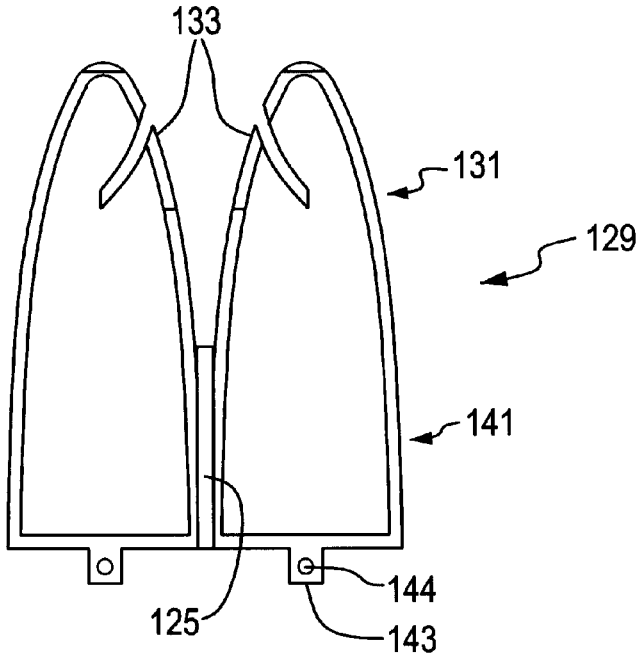
FIG. 7 is a perspective view of an open shell of an alternative embodiment, the shell having a longitudinal hinge.

FIG. 7 shows an alternative embodiment of the lighting apparatus in which shell 129 is formed as a pair of boat-shaped shells joined by a polypropylene-type hinge 125. In this embodiment, head portion 131 and base portion 141 are not separated as they are in the preferred embodiment. In this embodiment first string fastener 133, and second string fastener 143 with aperture 144, may be easier to mold.

In a further embodiment, not shown, the head and base are not formed as a pair but each has a screw thread permitting them to be screwed together for use and unscrewed to replace a battery.

In a further embodiment, not shown, a single LED light source mounted in the body provides light to all pads via fiber-optic bundles in the conduits. In this embodiment the term "lamp", as used herein, is deemed to include the light-emitting tip of one or more optic fibers.

In a further embodiment, not shown, as an alternative to requiring the flexibility of each conduit to conform the lighting apparatus to any balloon, the pads are hingedly and springedly attached to the end of the arm for rotary movement about the end of the arm.

In a further embodiment, not shown, the battery is omitted and the lighting apparatus is powered by an external source that may be a hand-held battery pack, or a power cord to a mains-powered step-down power supply.

Figure 8:
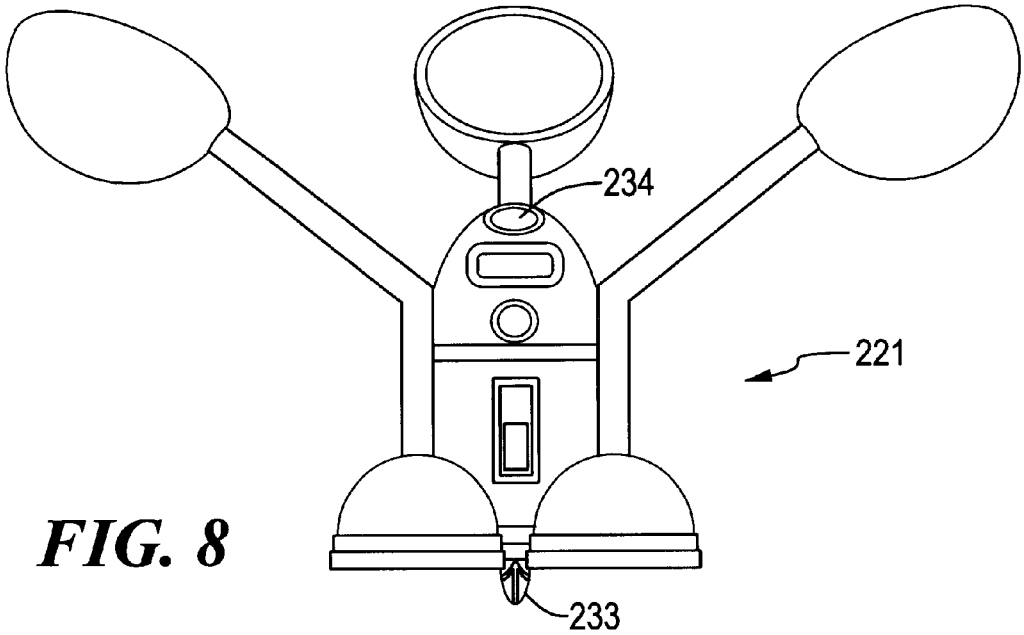
FIG. 8 is a perspective view of an alternative embodiment of the lighting apparatus in the form of a "space alien".

FIG. 8 is a perspective view of an alternative embodiment of the lighting apparatus in the form of a "space alien". The string passes axially through hole 234, through the center of lighting apparatus 221 to engage with second string fastener 233.

Figure 9:
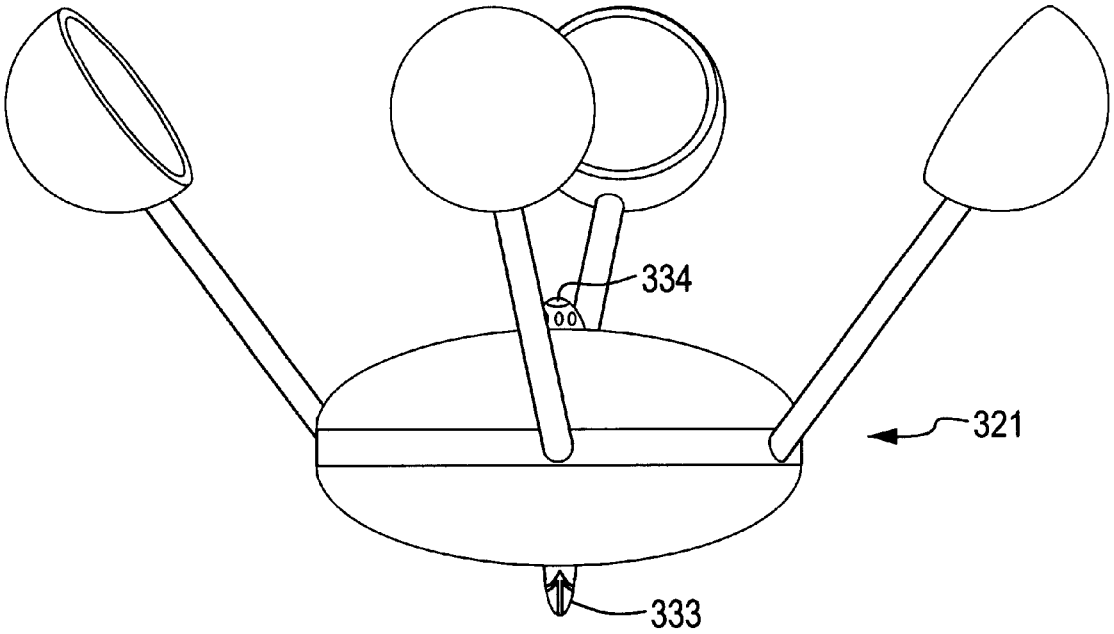
FIG. 9 is a perspective view of an alternative embodiment in the form of a flying saucer.

FIG. 9 is a perspective view of an alternative embodiment, the body formed as a clam shell such as to simulate a flying saucer with four extended legs. This embodiment uses three Duracell No. 357A, 1.5 volt, lithium batteries. The string passes axially through hole 334, between the batteries through the center of lighting apparatus 321 to engage with second string fastener 333.

Figure 10:
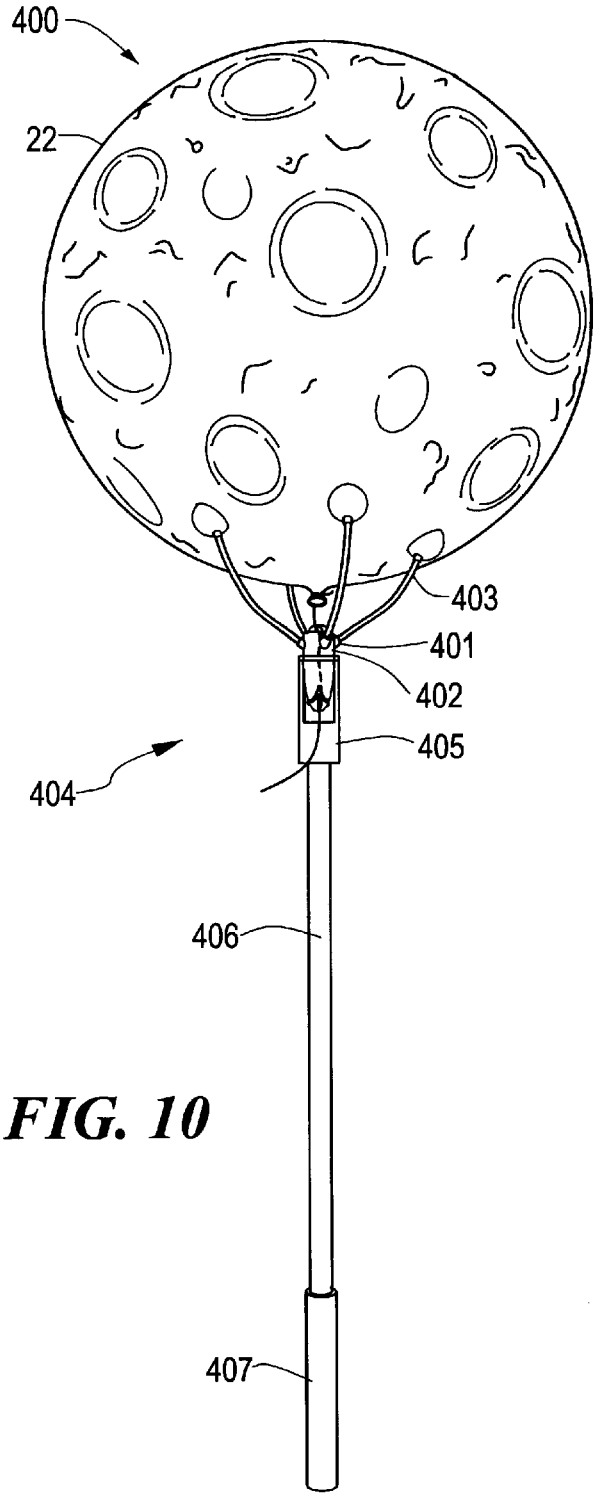
FIG. 10 is a perspective view of a first alternative embodiment including a handle-mounted balloon, the balloon simulating an illuminated moon.

FIG. 10 is a perspective view of a first alternative embodiment, a handle-mounted toy 400 simulating an illuminated moon. This embodiment includes balloon 22, lighting apparatus 401, with body 402 and at least three arms 403, and elongated handle 404. Elongated handle 404 includes a coupler 405 that is attached to the body, a rod portion 406 and a handle 407.

Figure 11:
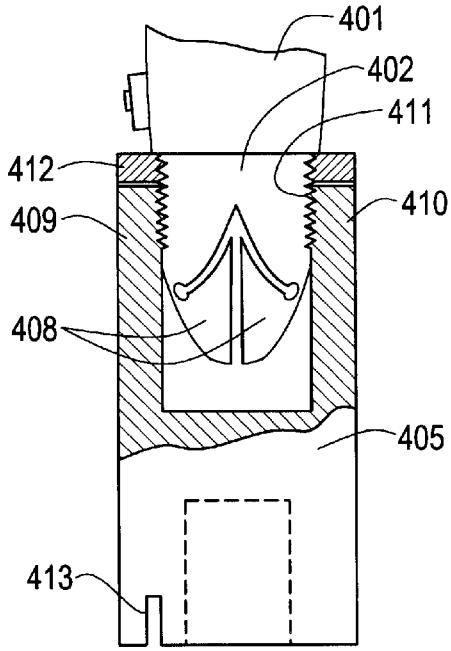
FIG. 11 is a partially cut-away front view of a portion of the toy of FIG. 10, illustrating a screw-on attachment of a lighting apparatus to an elongated handle.

FIG. 11 is a partially cut-away front view of a portion of the embodiment of FIG. 10, showing screw-on attachment of the lighting apparatus to the elongated handle. To allow access to first string fastener 408, coupler 405 defines a gap between the two threaded rigid fingers 409 and 410 that screw onto threaded portion 411 of body 402. The attachment is made secure with lock nut 412. Notch 413 is a convenient string fastener.

Figure 12:
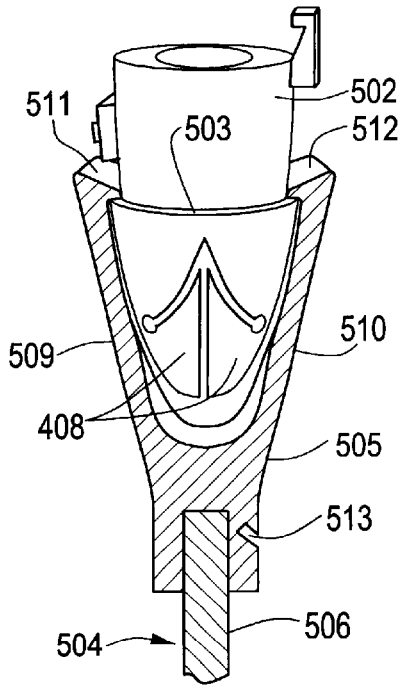
FIG. 12 is a partially cut-away front view of a portion of the toy, illustrating a second alternative embodiment including a first clip-on attachment of a lighting apparatus to the elongated handle.

FIG. 12 is a partially cut-away front view of a portion of a second alternative embodiment, showing clip-on attachment of the lighting apparatus to elongated handle 504. To allow access to first string fastener 408, coupler 505 defines a gap between clips 509 and 510. The attachment is secured to ridge 503 of the body by hooks 511 and 512. Notch 513 is a convenient string fastener.

A third alternative embodiment, not shown, having clip-on attachment of the lighting apparatus to the elongated handle, provides three spring-like fingers at equally spaced points on a circle, each finger terminating in an inward pointing blunt pin. The body of the lighting apparatus has three corresponding holes at equally spaced positions around its circumference. Each pin is sized to enter its corresponding hole so as to lock the body of the lighting apparatus to the elongated handle.

Figure 13:
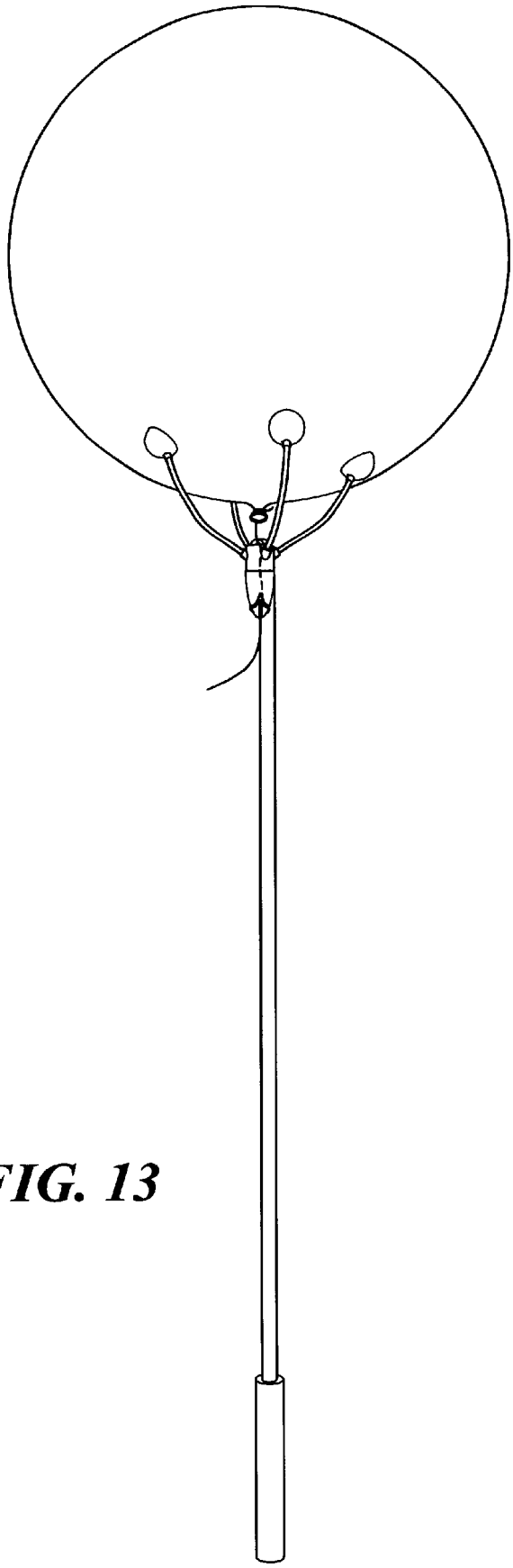
FIG. 13 is a perspective view of a fourth alternative embodiment of the assembled toy of the invention, showing the balloon, the string and the lighting apparatus fixedly mounted on an elongated handle.

A fourth alternative embodiment, shown in FIG. 13, provides a toy including an elongated handle fixedly attached to the lighting apparatus.

Figure 14:
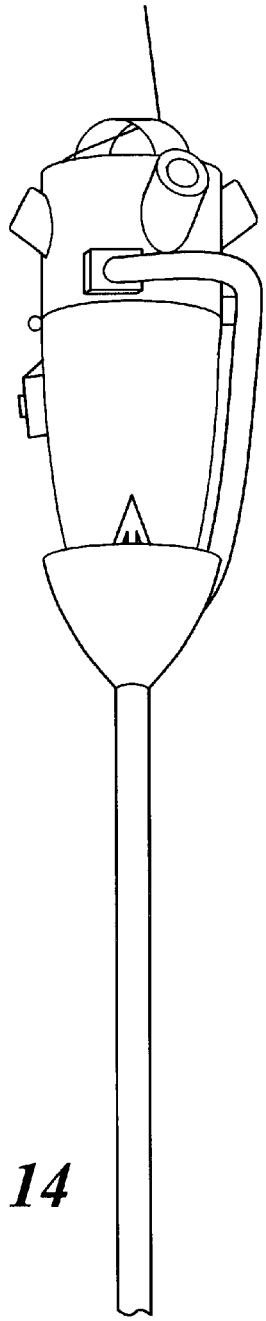
FIG. 14 is a perspective front view of a portion of the toy, illustrating a fifth alternative embodiment including a second clip-on attachment of a lighting apparatus to the elongated handle.

FIG. 14 is a front view of a portion of a fifth alternative embodiment, showing clip-on attachment of the lighting apparatus to the elongated handle.

Figure 15:
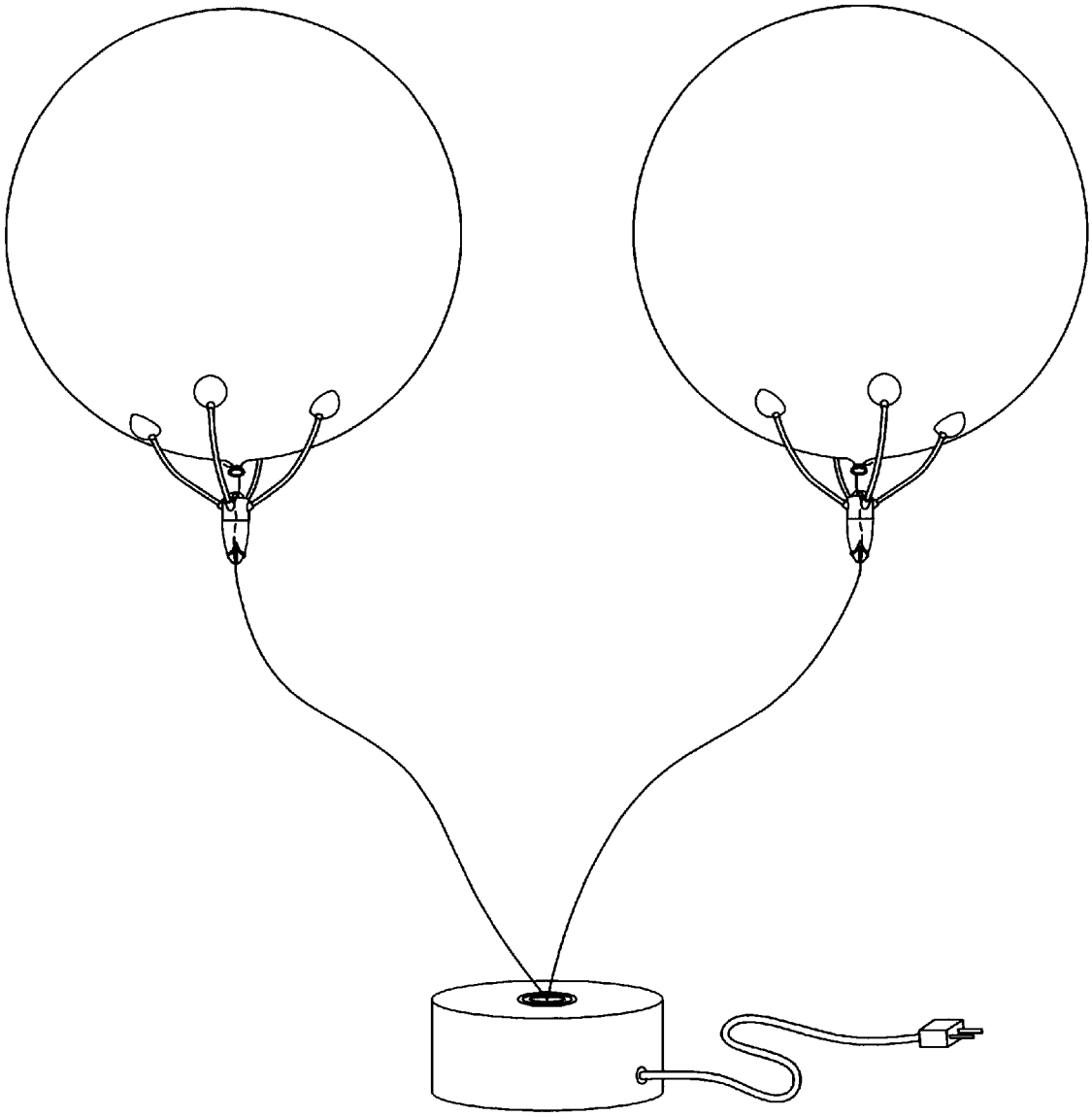
FIG. 15 is a perspective view of sixth alternative embodiment, showing two balloons, both powered from a shared power supply using utility or battery power.

FIG. 15 is a perspective view of a sixth alternative embodiment, showing two balloons, both powered from a shared power supply connected to utility or battery power. In this embodiment the balloons may be tethered and filled with lighter than air gas, or may be post-mounted and filled with air.

Using the Invention

Light provided by the lighting apparatus shines through the skin of the balloon and into the interior of the balloon. Phosphorescent materials contained in the skin of the balloon diffuse the light from the lighting apparatus, giving the balloon the appearance of a glowing moon. The lighting apparatus resembles a lunar rocket standing on legs on the moon's surface. Because of the limited light output of LED's, best results are achieved after sunset or under very low light conditions. Alternatively, in an embodiment that would probably be more expensive, fluorescent materials could be used.

After the balloon is filled with helium gas, the neck is knotted so as to prevent the gas from escaping. The lighting apparatus is tied under the balloon and in such a fashion that the four pads of the lighting apparatus are held tight against the skin of the balloon. The length of string that is attached to the knotted end of the balloon at one end and to the lighting apparatus at the other end provides the tension that holds the lighting apparatus firmly against the balloon.

The preferred sequence of steps for attaching the lighting apparatus to the balloon are shown in FIGS. 5A–5D, as follows.

Figure 5A:
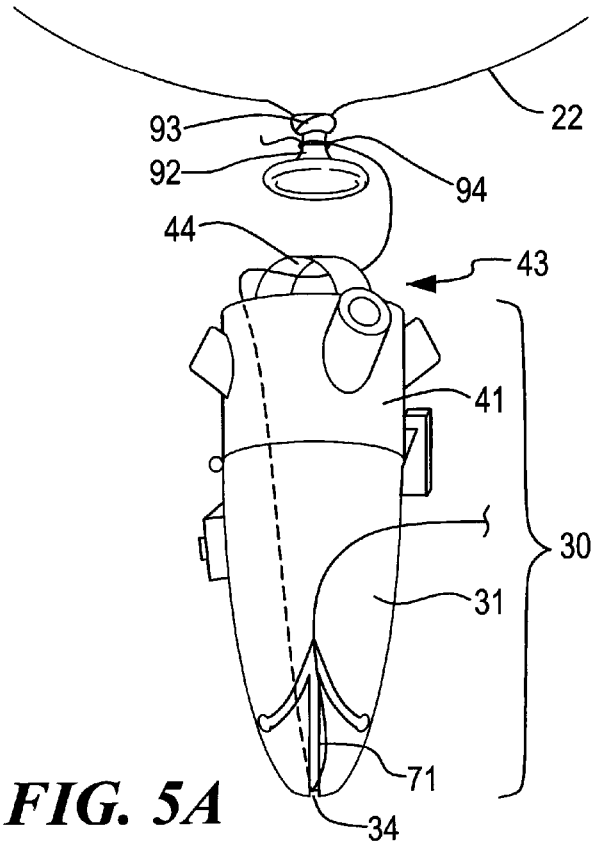
FIGS. 5A–5D illustrate the method of attachment of the string to the lighting apparatus.

Referring to FIG. 5A:

Inflate the balloon and tie the neck 92 of the balloon to make balloon knot 93. Then tie string 23 to make string knot 94 around the knotted neck of the balloon.

Holding the lighting apparatus centered over the neck of the balloon (as shown in FIG. 1), thread the free end of the string through hole 44 of second string fastener 43. Pass the free end of the string axially behind body 30 of the lighting apparatus and into the notch at the tip 34 of head 31. After tensioning the string to put proper tension in the string (See string 23 in FIG. 5B), hold the string in place at tip 34 while threading the string axially up the front of the body through axial cut 71.

Figure 5B:
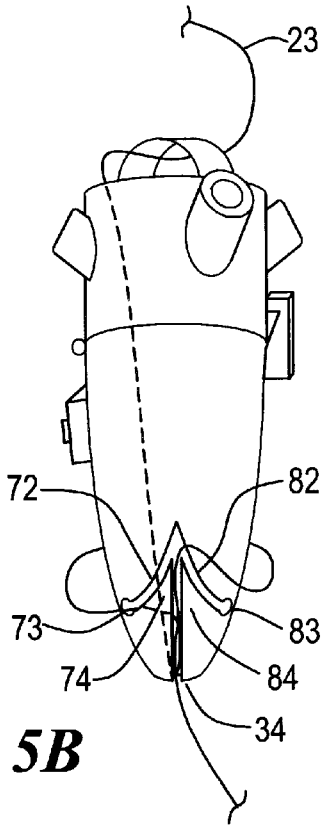

Referring to FIG. 5B:

Still holding the string in place at tip 34, push the string into axial cut 71 and into first end 73 of first transverse cut 72 so that it passes within the hollow body, behind first hook 74, from axial cut 71 and first end 73. Then pass the free end of the string around the back of the body to once more engage axial cut 71.

Figure 5C:
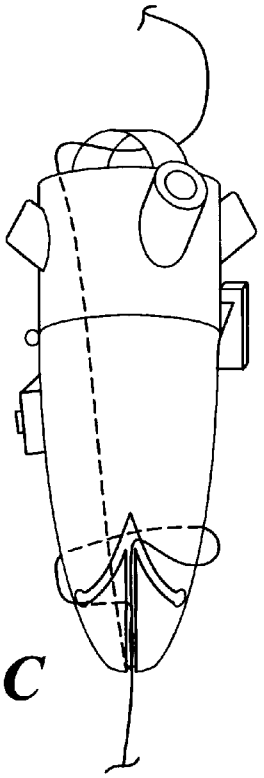

Referring to FIG. 5C:

Holding the string in place around the back of the body, press the string into axial cut 71 so that the free end of the string extends from the tip 34 of the head.

Figure 5D:
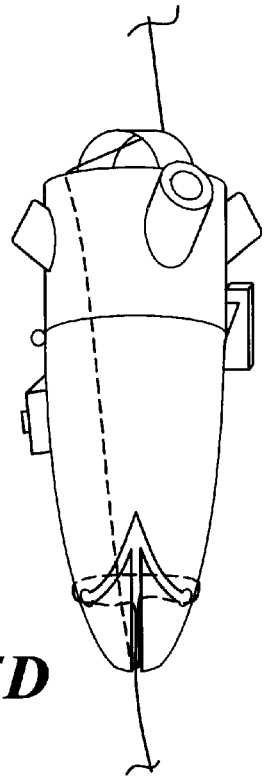

Referring to FIG. 5D:

Still holding the string in place around the back of the body, pull the free end of the string tight so as to push the string again into axial cut 71, but this time into second end 83 of second transverse cut 82, so that it passes within the hollow body, behind second hook 84, between axial cut 71 and second end 83 of second transverse cut 82. This locks the string.

The string should now be firmly secured to the lighting apparatus and to the balloon, and the lighting apparatus should now be firmly held in tension against the balloon.

When using an embodiment in which the balloon is filled with helium, it is recommended that the free end of the string be tied to a heavy object or to the user's wrist or arm to prevent the toy from floating away.

What is claimed is:

1. A toy, comprising:

a lighting apparatus having a window;

an inflated balloon having a skin and a neck; and a first portion of a length of string;

wherein the first portion of the length of string is attached under tension between the lighting apparatus and the neck of the balloon, and wherein the window is in contact with the skin.

2. A toy according to claim 1, wherein the lighting apparatus includes a body with three arms extending from the body, at least one arm terminating in a pad having a window; and a lamp positioned within the lighting apparatus such that light from the lamp shines through the window.

3. A toy according to claim 2, wherein the toy is sufficiently light-weight to float in air when the balloon is inflated with a lighter than air gas.

4. A toy according to claim 2, wherein the lighting apparatus includes a locking fastener.

5. A toy according to claim 2, wherein the lighting apparatus is entirely outside the balloon.

6. A toy according to claim 2, wherein the balloon is shaped to resemble the earth's moon.

7. A toy according to claim 2, wherein the body is shaped to resemble a long-legged spacecraft.

8. A toy according to claim 2, wherein the body is mounted to a handle.

9. A lighting apparatus for illuminating an inflated balloon having a skin and a neck, the neck attached to a length of string, the lighting apparatus comprising:

a body with three arms extending therefrom, each arm terminating in a pad, one of said pads having a window adapted for contact with an inflated balloon;

a locking fastener for attaching the body to a portion of the length of string; and a lamp, positioned within the lighting apparatus such that light from the lamp shines through the window.

10. A lighting apparatus according to claim 9, wherein each arm terminates in a window.

11. A lighting apparatus according to claim 9, wherein the locking fastener includes a first string fastener having two hooks.

12. A lighting apparatus according to claim 11, wherein the body includes a hinged shell with slots, the slots defining the two hooks.

13. A lighting apparatus according to claim 9, wherein the locking fastener includes a first string fastener and a second string fastener.

14. A lighting apparatus according to claim 11, wherein the body includes a hinged shell wired to accept a battery.

15. A lighting apparatus according to claim 9, wherein each arm is flexible, and each pad is adapted for rotary movement about the end of its arm.

16. A method for attaching a lighting apparatus to an inflated balloon, the method comprising the steps of:

providing an inflated balloon having a neck;

providing a lighting apparatus having a body including a head defining a locking fastener with first and second hooks, and a base with three arms extending therefrom;

tying one end of a length of string to the neck;

orienting the lighting apparatus with arms in contact with the balloon straddling the neck of the balloon;

threading the free end of the string through a fastener in the base;

passing the free end axially along the outside of the body and behind the first hook;

passing the free end radially around the body and behind the second hook; and pulling the free end tight to lock the string under tension to the locking fastener and to hold the arms in contact with the balloon by the tension in the string.

* * * * *

UNITED STATES PATENT AND TRADEMARK OFFICE

CERTIFICATE OF CORRECTION

PATENT NO. : 6,390,651 B2
DATED : May 21, 2002
INVENTOR(S) : Timothy R. Bertrand It is certified that error appears in the above-identified patent and that said Letters Patent is hereby corrected as shown below:

Title page,
Item [76], inventor's address should read -- 611 June Street, Suite #2, Fall River, MA 02720 (US) --.

Signed and Sealed this

Twenty-ninth Day of April, 2003

JAMES E. ROGAN
*Director of the United States Patent and Trademark Office*